US005964647A

United States Patent [19]

Henky

[11] Patent Number: 5,964,647

[45] Date of Patent: Oct. 12, 1999

[54] METHOD AND DEVICE FOR REMEDYING THE FRAGILITY OF THE EDGES OF A SPECTACLE LENS MADE OF RIGID MATERIAL AND CORRESPONDING SPECTACLE LENS

[75] Inventor: Francis Henky, Bar-Le-Duc, France

[73] Assignee: Essilor International Compagnie Generale d'Optique, Charenton Le Pont, France

[21] Appl. No.: 08/809,472

[22] PCT Filed: Sep. 26, 1995

[86] PCT No.: PCT/FR95/01235

§ 371 Date: Apr. 18, 1997

§ 102(e) Date: Apr. 18, 1997

[87] PCT Pub. No.: WO96/09914

PCT Pub. Date: Apr. 4, 1996

[30] Foreign Application Priority Data

Sep. 27, 1994 [FR] France ..... 94 11499

[51] Int. Cl.[6] ..... B24B 9/14

[52] U.S. Cl. ..... 451/43; 451/57; 451/256; 451/325

[58] Field of Search ..... 451/41, 42, 43–44, 451/57, 173, 255, 256, 325

[56] References Cited

U.S. PATENT DOCUMENTS

| | | | |
|---|---|---|---|
| 3,528,326 | 9/1970 | Kilmer et al. . | |
| 3,641,991 | 2/1972 | Haber . | |
| 3,736,115 | 5/1973 | Blum . | |
| 3,778,936 | 12/1973 | Steadman . | |
| 5,056,270 | 10/1991 | Curcher | 451/41 |
| 5,149,337 | 9/1992 | Watanabe | 451/41 |
| 5,158,422 | 10/1992 | Wagner . | |
| 5,299,394 | 4/1994 | Surdacki . | |
| 5,454,748 | 10/1995 | Gottschald | 451/41 |

FOREIGN PATENT DOCUMENTS

| | | |
|---|---|---|
| 0 515 036 | 11/1992 | European Pat. Off. . |
| 2184473 | 12/1973 | France . |
| 27 02 261 | 7/1977 | Germany . |
| 33 38 240 | 5/1984 | Germany . |

*Primary Examiner*—Eileen P. Morgan
*Attorney, Agent, or Firm*—Young & Thompson

[57] ABSTRACT

Method and apparatus to eliminate the sharp edge between each of the faces of an ophthalmic lens blank and the peripheral cylindrical surface therebetween. The connecting zone between each face and the cylindrical surface initially includes an edge. A cylindrical deburring tool is mounted on a tool support for pivotal movement orthogonal to the axis of the lens. Rotation of the deburring tool about its axis is prevented. The angle position of the deburring tool is adjustable. A spring urges the mounting to a rest position. A drive displaces the tool support.

14 Claims, 2 Drawing Sheets

METHOD AND DEVICE FOR REMEDYING THE FRAGILITY OF THE EDGES OF A SPECTACLE LENS MADE OF RIGID MATERIAL AND CORRESPONDING SPECTACLE LENS

The present invention concerns spectacle lenses made of rigid material.

In this context, the expression "spectacle lenses" refers in the usual way to positive or negative focal power blanks usually having a circular initial contour and which have to be trimmed to fit the specific contour of a spectacle frame to which they are to be fitted.

It applies equally to finished products, that is to say products both faces of which already have their final profile, and semi-finished products, that is to say products where at least one face has still to be worked until it has the final profile.

In all cases their edge surface or peripheral rim is globally cylindrical and each face intersects it along an edge which at present is a sharp edge and which is therefore relatively fragile, given the rigid material from which they are made.

Such spectacle lenses are usually subjected during production and before trimming, to be more precise before they are shipped to the practitioners who usually carry out such trimming, to a certain number of manipulations necessary, for example, for dipping them into various treatment solutions, for example washing and coating solutions and solutions of other types.

Given the fragile nature of their edges, in particular in the case of spectacle lenses made from organic materials, such manipulation almost inevitably leads to the separation of small flakes of material along these edges, often called "flashes".

Accordingly, at the present time spectacle lenses of this type are usually shipped to practitioners with edges that are chipped to a greater or lesser degree.

Of course, the visible damage to which these spectacle lenses are subjected in this way is in practise of no consequence for their subsequent use, since it affects a portion of them that is trimmed off.

From the commercial point of view, however, it is prejudicial to their esthetic appearance.

Moreover, and more importantly, the flakes that chip off the spectacle lenses in question when they are manipulated inevitably pollute the corresponding treatment solutions, in which they progressively accumulate.

These treatment solutions must therefore be renewed from time to time, which is detrimental from the cost point of view.

If they were not renewed from time to time, the flashes that they contain could find their way onto the spectacle lenses dipped in them.

The present invention consists firstly in a method and a device for avoiding these problems by remedying the fragility of at least one edge of a rigid material spectacle lens, in practise each edge; the present invention also consists in any rigid material spectacle lens in which the fragility of at least one edge has been remedied in this manner.

In accordance with the invention, an edge of this kind is replaced by a globally rounded connecting surface which preferably merges substantially tangentially with the edge surface at least of the spectacle lens and which, even more preferably, merges substantially tangentially both with the edge surface of the spectacle lens and with the corresponding face of the latter.

In practise this is effected by machining the lens, by applying a deburring tool to the edge to be treated, with the deburring tool rotating relative to the spectacle lens about the axis of the latter.

In use, deburring tool can preferably pivot relative to the spectacle lens about a pivot axis orthogonal to the axis of the lens, with this pivot axis displaced along a path contained in a plane passing through the axis of the spectacle lens and globally oblique to the latter.

Although extending only a short distance onto the edge surface of the spectacle lens and the face concerned of the latter, the connecting surface provided in accordance with the invention between the edge surface and the face advantageously provides a particularly simple and effective way of preventing flakes being chipped off the periphery of the spectacle lens during its subsequent manipulation.

Published French patent application No 2 184 473 discloses the application of a tool to the edge surface of a lens.

However, it concerns a soft material contact lens and the tool, which is flat, works all of the edge surface of the contact lens, by alternately deflecting it, which confers upon this edge surface a rounded profile making it more comfortable for the wearer.

The above French patent application is therefore not concerned with working on only the edges of the edge surface of a rigid material spectacle lens to remedy its fragility during treatment and thereby enhance the latter.

In German patent application No 27 02 261 the part worked is a silicon disc the edges of which must be removed for safety reasons, and the tool used to achieve this is itself a disc.

Like French patent application No 2 184 473, U.S. Pat. No. 3,736,115 concerns a flexible material contact lens the edge surface of which must be given a globally rounded profile.

The tool used to this end extends globally transversely to the axis of the lens and is oscillated about its own axis.

Thus the overall aim of the present invention is different from that of the above prior art, and the same applies to the means employed to this end and the results obtained.

The features and advantages of the invention will emerge from the following description given by way of example and with reference to the accompanying diagrammatic drawings, in which.

The above figures show, by way of example, the application of the invention to a concave-convex spectacle lens 10, i.e. a negative focal power spectacle lens 10.

In practise the spectacle lens 10 is made from a rigid material, to be more precise a rigid organic material.

It may be polycarbonate, for example, a compound based on diethyleneglycol diallylcarbonate, or a compound of the type that is the subject matter of French patents Nos 2 699 541 and 2 703 056.

In a manner that is known in itself, the spectacle lens 10 has a concave rear face 11, a convex front face 11' and an edge surface 12 forming the peripheral rim of the lens, along a cylindrical, in practise circular contour.

The spectacle lens 10 has an optical axis A1.

The edge surface 12 is a cylindrical edge surface defined by generator lines parallel to the axis A1.

Figure 5:
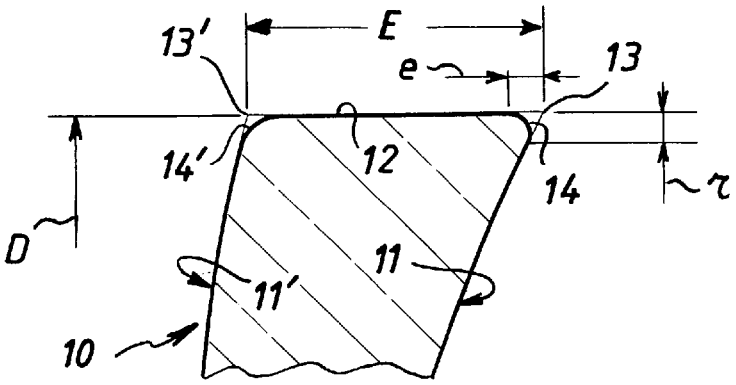
FIG. 5 is a view to a larger scale and in axial section of the peripheral part of a spectacle lens to which the invention has been applied.

As can be seen more clearly in FIG. 5, in which it is shown diagrammatically in thin outline, the edge 12 normally intersects the faces 11, 11' along two sharp edges 13, 13'.

The cylinder on which the edge surface 12 lies, i.e. the peripheral contour of the faces 11, 11', has a diameter D and the edge surface 12 has an axial length E measured between the edges 13, 13', i.e. the spectacle lens 10 has a thickness E at its peripheral edge.

In accordance with the invention, at least one of the edges 13, 13', in practise each of them, is replaced by a rounded connecting surface 14, 14' which preferably merges substantially tangentially with at least the edge surface 12 of the spectacle lens 10.

Even more preferably, this connecting surface 14, 14' merges substantially tangentially both with the edge surface 12 of the spectacle lens 10 and with the corresponding face 11, 11' of the latter.

In accordance with the invention, to achieve this it is proposed to submit the spectacle lens 10 to a machining pass during which, as described in more detail hereinafter, a deburring tool 15, 15' is applied to its edge 13, 13' to be treated, with the deburring tool 15, 15' rotating relative to the spectacle lens 10 about the axis A1 of the latter.

As described in more detail hereinafter, in use and in accordance with the invention, the deburring tool 15, 15' can preferably pivot relative to the spectacle lens 10 about a pivot axis A2 orthogonal to the axis A1 of the lens, and the pivot axis A2 is displaced along a path T, T' contained in a plane passing through the axis A1 of the spectacle lens 10 and oblique to the latter.

Figure 1:
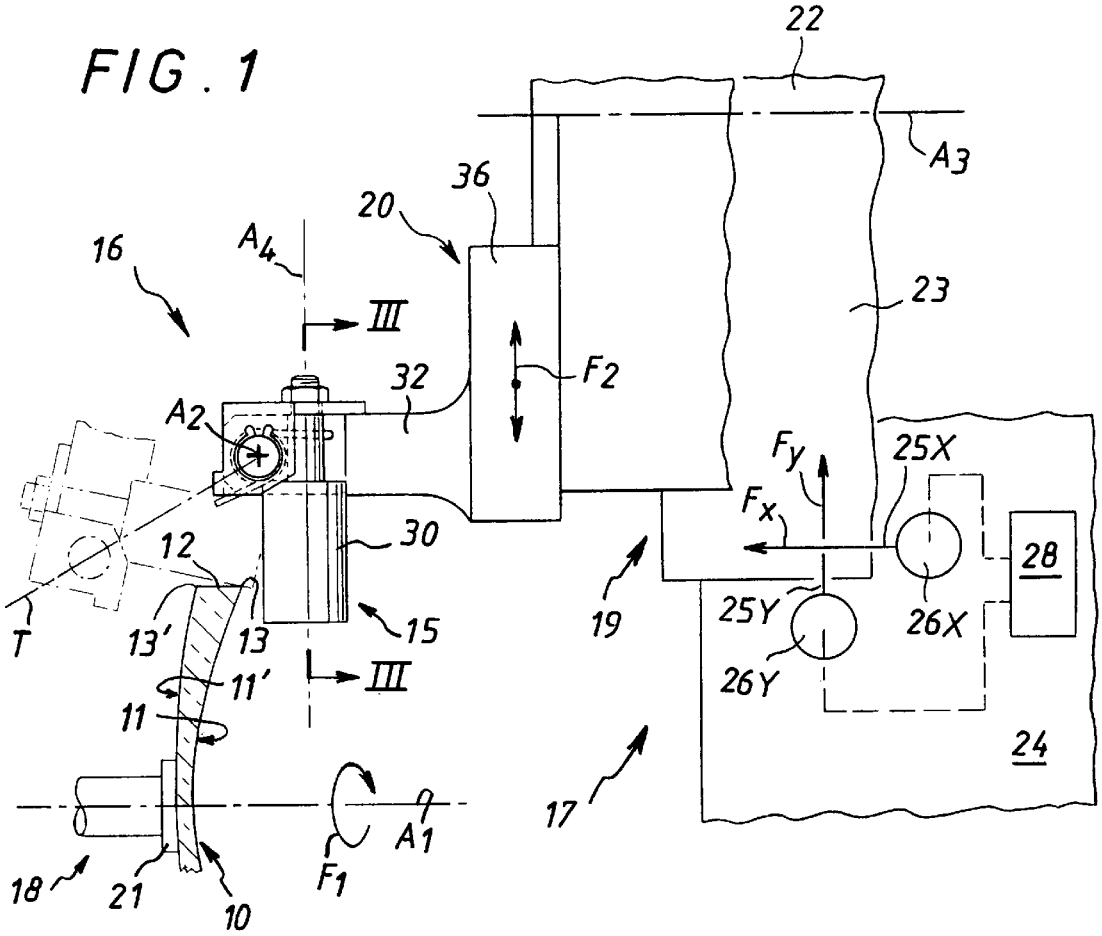
FIG. 1 is an elevation view of a machining device for implementing the invention, for a first type of deburring tool, with a fragmentary view in axial section of a spectacle lens to be treated.
Figure 2:
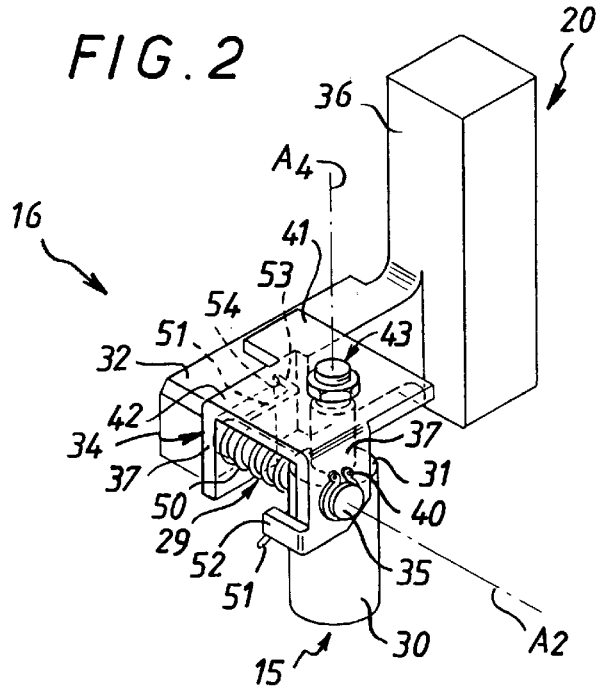
FIG. 2 is a fragmentary perspective view of this machining device.
Figure 3:
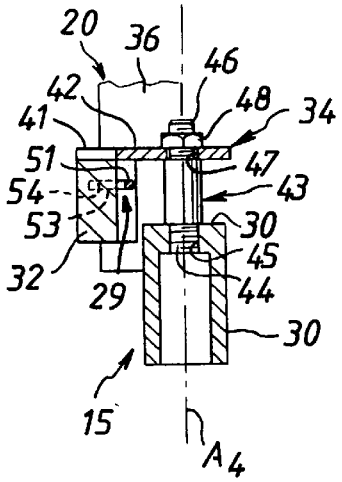
FIG. 3 is a fragmentary cross-sectional view of it taken along the line III—III in FIG. 1.
Figure 4:
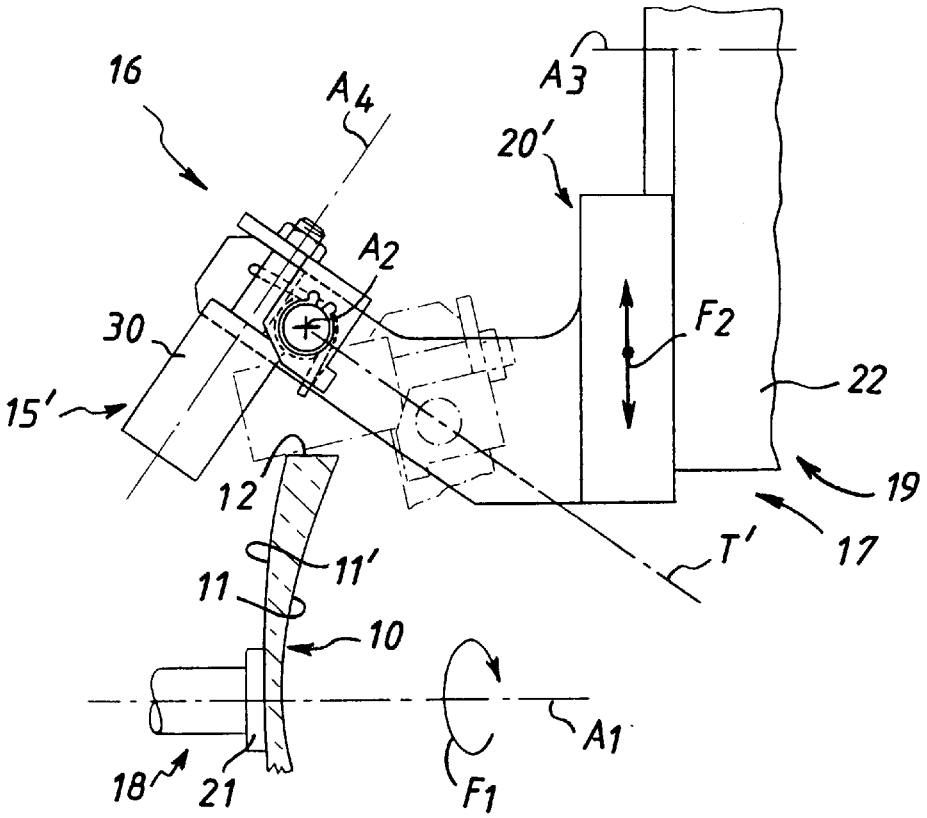
FIG. 4 is an elevation view similar to that of FIG. 1, for a second type of deburring tool.

The location of the pivot axis A2 is shown diagrammatically in FIGS. 1 and 4 and this axis is shown in chain-dotted line in FIG. 2.

The path T, T' is shown in chain-dotted line in FIGS. 1 and 4.

The deburring tool 15, 15' is applied by means of a machining device 16.

For example, the machining device 16 may be fitted to a numerically controlled machine 17 of the type sold by EMCO under the tradename "EMCOTURN 320" for trimming spectacle lenses 10 when trimming is systematically applied after fabrication to eliminate a peripheral area likely to be affected by microcracks that may cause problems during any subsequent treatment.

As a machine 17 of this kind is well known in itself, and is not in itself relevant to the present invention, it will not be described here.

Only its components necessary to an understanding of the invention will be described, or to be more precise mentioned, here.

Suffice to say that the machine 17 includes support means 18 adapted to receive the spectacle lens 10 to be treated and to rotate it about an axis which in practise is its own axis A1, as shown diagrammatically by the arrow F1 in FIG. 1, and drive means 19 adapted to displace a tool support 20, 20' in a plane passing through the axis A1.

The support means 18 may comprise a shaft, for example, coaxial with the axis A1, rotated about the axis A1 by drive means and equipped at the end with any kind of holding device 21, for example a sucker or a holding block, to hold the spectacle lenses 10.

Alternatively, the support means 18 may comprise two shafts or two half-shafts aligned with each other and adapted to grip the spectacle lens 10 between them.

In the remainder of this description, the reference symbol A1 refers interchangeably to the optical axis of the spectacle lens 10 and to the rotation axis of the support means 18.

In the embodiment shown, the drive means 19 include a turret 22 the angular position of which about an axis A3 parallel to the rotation axis A1 of the support means 18 can be adjusted and which includes circumferentially around the axis A3 at least two separate and spaced apart tool supports, namely a tool support 20 fitted with a deburring tool 15 for treating the rear edge 13 of the spectacle lens 10 and a tool support 20' fitted with a deburring tool 15' for treating the front edge 13' of the spectacle lens 10.

In practise the turret 22 also carries a third tool support, not shown, fitted with a deburring tool.

As shown diagrammatically by an arrow F2 in FIGS. 1 and 4, the tool supports 20, 20' are preferably mobile radially on the turret 22 and can be locked in position on the latter.

Accordingly, each of them can be moved individually from a deployed position in which, as shown, the deburring tool 15, 15' that it carries is active, i.e. disposed to interfere with the spectacle lens 10 as its pivot axis A2 moves along the path T, T', to a retracted position, not shown, in which the deburring tool 15, 15' is inactive, i.e. disposed so as not to interfere with the spectacle lens 10 during this movement.

To move the pivot axis A2 of the deburring tool 15, 15' along the path T, T', the turret 22 is carried by an XY table 23, for example, in turn carried by a fixed frame 24 and incorporating cross-motion members 25X, 25Y.

As shown diagrammatically by the arrow $F_X$ in FIG. 1, for example, the member 25X that carries the turret 22 and is driven by a motor 26X is mobile parallel to the rotation axis A1 of the support means 18 and, conjointly, as shown diagrammatically by the arrow $F_Y$ in FIG. 1, the member 25Y that carries the member 25X and is driven by a motor 26Y is mobile along an axis perpendicular to the rotation axis A1.

As shown diagrammatically in dashed line in FIG. 1, the motors 26X, 26Y are controlled by a common control unit 28.

The trajectory T, T' of the tool support 20, 20' and therefore of the pivot axis A2 of the deburring tool 15, 15' is the result of the combination of the movements that they impart.

As the foregoing arrangements defining a path T, T' of this kind are well known in themselves, they will not be described in greater detail here.

In accordance with the invention, the deburring tool 15 is pivotally mounted on the tool support 20 that carries it, pivoting about the pivot axis A2 orthogonal to the rotation axis A1 of the support means 18, and is acted on by return spring means 29 which urge it at all times towards a particular fixed rest position shown in continuous outline in FIG. 1.

The deburring tool 15 is in practise an abrasive tool.

In the embodiment shown its working surface 30 is a circular cross-section cylindrical surface having an axis A4 orthogonal to its pivot axis A2.

In practise the deburring tool 15 is in the form of an elongate sleeve closed at one end by a transverse end wall 31.

The axial length of its working surface 30 is much greater than the diameter of its cross-section.

In the embodiment shown, the tool support 20 includes a finger 32, to which the deburring tool 15 is attached by means of a support member 34 pivotally engaged on a journal 35 projecting from the finger 32 perpendicularly to the rotation axis A1 of the support means 18, and a baseplate 36 by which it is attached to the turret 22 and which carries the finger 32.

Being the support for the deburring tool 15 for treating the rear edge 13 of the spectacle lens 10, the finger 32 is in practise substantially perpendicular to the baseplate 36.

In the embodiment shown, the support member 34 is in the form of a yoke and its arms 37 are pivotally engaged on the journal 35.

A split elastic ring 40 engaged in a groove in the journal 35 retains the support member 34 on the journal 35, pressing one arm 37 of the support member 34 against the finger 32 of the tool support 20.

The support member 34 also has a heel-piece 41 which bears on the finger 32 of the tool support 20 in the rest position.

In the embodiment shown, this heel-piece 41 is in practise formed by a lateral extension of the middle part 42 of the support member 34.

In use, the deburring tool 15 is prevented from rotating about the axis A4 of its working surface 30.

In other words, in use it does not turn about this axis A4.

However, for reasons that are explained hereinafter, the angular position of the deburring tool 15 about the axis A4 of its working surface 30 is preferably adjustable.

As shown here, for example, it is therefore carried by a pin 43 which has a screwthreaded section 44 at one end, for example, by means of which it is screwed into a screwthreaded bore 45 in the end wall 31 of the deburring tool 15 and which has a screwthreaded section 46 at the other end which, after passing through the support member 34, to be more precise through a bore 47 in the middle part 42 of the latter, has a locknut 48 screwed onto it.

In the embodiment shown, the return spring means 29 acting on the deburring tool 15 are formed by a torsion spring the median torsion part 50 of which is engaged with the journal 35, between the arms 37 of the support member 34, and one branch of which 51 bears on the support member 34, being engaged under a right-angle lug 52 provided for this purpose on the inside of one of the lateral arms 37, whereas the other branch 51 bears on the finger 32 of the tool support 20, having to this end a right-angle lug 53 engaged in a bore 54 in the finger 32, for example.

Initially, in the rest position shown in continuous outline in FIG. 1, the axis A4 of the working surface 30 of the deburring tool 15 is substantially perpendicular to the rotation axis A1 of the support means 18 and therefore to the optical axis of the spectacle lens 10.

In use, the spectacle lens 10 is rotated by the support means 18 and, given the path T followed by the pivot axis A2 of the deburring tool 15, as specified hereinabove, one generator line of working surface 30 of the deburring tool 15 comes into contact with its rear edge 13.

As the engagement movement of the turret 22 relative to the spectacle lens 10 along the path T continues, the deburring tool 15 is held in contact with the spectacle lens 10 by its return spring means 29 but tilts progressively about its pivot axis A2, so moving around the rear edge 13 of the spectacle lens 10, and therefore machining this rear edge 13, until it lies on the edge surface 12 of the spectacle lens 10, substantially parallel to this edge surface 12 or slightly oblique to it, as shown diagrammatically in chain-dotted line in FIG. 1.

The conjugate effect of the various rotation, pivoting and engagement movements is to provide the required globally rounded connecting surface 14.

In practise the connecting surface 14 merges substantially tangentially with at least the edge surface 12 of the spectacle lens 10.

It preferably merges substantially tangentially with both the edge surface 12 of the spectacle lens 10 and with the rear face 11 on the latter, and tests have confirmed this occurs in practise with the machining device 16 described.

If necessary, to improve the tangential relationship of the connecting surface 14 to the rear face 11 of the spectacle lens 10, in the rest position of the system the axis A4 of the working surface 30 of the deburring tool 15 is initially inclined accordingly.

For example, the finger 32 of the tool support 20 could be pivotally mounted and its angular position could be adjustable on the baseplate 36 which carries it.

The radial extent r of the connecting surface 14 on the rear face 11 of the spectacle lens 10 from the edge surface 12 is in practise between 0.1 mm and 1 mm and its axial extent e on the edge surface 12 from the rear face 11, i.e. from the corresponding rear edge 13, is between 0.1 mm and 1 mm (see FIG. 5).

The generator line of the connecting surface 14 in a radial plane of the spectacle lens 10 can in practise be a curve of any shape.

However, it is preferably a circular arc with a radius between 0.15 mm and 0.5 mm, for example around 0.25 mm, and tests have shown that this is in practise obtained with the machining device 16 described.

The generator line of the connecting surface 14 may have any other configuration, however, for example, it may be elliptical.

By momentarily loosening the locknut 48 and turning the deburring tool 15 about the axis A4 of its working surface 30, it is advantageously possible to vary the active generator line of the latter and therefore to use all of the working surface 30.

The deburring tool 15' used to machine the front edge 13' of the spectacle lens 10 is identical to the above deburring tool 15.

The same applies to the other components concerned, except for the tool support 20', the finger 32 of which is oblique to the baseplate 36 so that, in the rest position of the system, as shown in continuous outline in FIG. 4, the axis A4 of the working surface 30 of the deburring tool 15' is initially oblique to the rotation axis A1 of the support means 18.

The corresponding angle is in the order of 45°, for example.

The connecting surface 14' obtained is of the same kind as the connecting surface 14, and its radial and axial dimensions are of substantially the same order.

In all cases, the tool support 20, 20' can follow any path T, T'.

This path is preferably rectilinear, however.

In this case, the angle between it and the rotation axis A1 of the support means 18 is preferably between 30° and 45°.

The present invention is not limited to the embodiments described and shown but encompasses any variant execution thereof.

I claim:

1. Method of preparing an ophthalmic lens blank having front and rear faces, one of the faces being concave, and a cylindrical peripheral edge surface disposed between said front and rear faces, a connecting zone connecting each face and said cylindrical peripheral edge surface comprising a ridge, the method comprising the steps of: rounding the connecting zone between at least the concave one of said faces and the cylindrical peripheral edge surface to eliminate the ridge and joining the resulting rounded connecting zone substantially tangentially to at least the cylindrical peripheral edge surface.

2. Method according to claim 1, wherein said rounding and joining steps comprise machining the connecting zone with a deburring tool and cylindrical working surface while effecting relative rotation between the deburring tool and the lens blank about the axis of the lens blank.

3. Method according to claim 2, further comprising during said rounding and joining steps pivoting the deburring tool about a pivot axis orthogonal to the axis of the lens blank while displacing the pivot axis along a path located in a plane intersecting the axis at an oblique angle thereto.

4. Method according to claim 1, further comprising rounding the connecting zone between the other of said faces and the cylindrical peripheral edge surface to eliminate the edge therein and joining the resulting rounded connected zone substantially tangentially to at least said cylindrical peripheral edge surface.

5. Method according to claim 1, further comprising also joining the resulting connecting zone substantially tangentially to said concave face.

6. Method according to claim 5, further comprising also joining the resulting connecting zones substantially to the respective faces.

7. A machine for preparing an ophthalmic lens blank having front and rear faces, one of said faces being concave, and a cylindrical peripheral edge surface disposed between said front and rear face, a connecting zone connecting each face and the cylindrical peripheral edge surface, said machine comprising a support means for supporting a lens blank for rotation about an axis of rotation, a tool support mounted for movement in a plane passing through the rotation axis, a deburring tool including a working surface having a circular cross section cylindrical surface with an axis and a diameter, said working surface having an axial length greater than the diameter thereof, means mounting the deburring tool on said tool support for pivoting movement about a pivot axis, orthogonal to the rotation axis of said support means, means for preventing rotation of said deburring tool about said working surface axis during operation of the deburring tool, means for adjusting the angular position of said deburring tool about said working surface axis, spring biasing means for urging said deburring tool towards a predetermined rest position, and drive means for displacing the tool support and the pivot axis therewith along a path of movement lying in the plane passing through the rotation axis of support means.

8. Machine according to claim 7, wherein the tool support includes a finger, the deburring tool being attached to the finger by means of a support member pivotally engaged on a journal projecting from the finger perpendicularly to the rotation axis of said support means.

9. Machine according to claim 8, wherein said pivotal support member is engaged in a journal projecting from said finger perpendicularly to the rotation axis of said support means.

10. Machine according to claim 9, wherein the return spring means of the deburring tool is formed by a torsion spring having a median torsion part engaged with the journal and one branch, the median torsion part bearing on the support member and another branch thereof bearing on the finger of the tool support.

11. Machine according to claim 9, wherein the support member of the deburring tool has a heel-piece member bearing on the finger of the tool support in the rest position.

12. Machine according to claim 8, wherein the deburring tool is carried by a pin having a screwthreaded section, a locknut being screwed on the screwthread section after it passes through the support member.

13. Machine according to claim 8, wherein the deburring tool is an abrasive tool.

14. Machine according to claim 8, wherein the tool support is supported by a turret, the turret having an angular position adjustable about an axis parallel to the rotation axis of the support means, said turret carrying circumferentially around to axis adjustment at least two separate spaced apart said tool supports.

* * * * *